US007481007B2

(12) United States Patent
Resch et al.

(10) Patent No.: US 7,481,007 B2
(45) Date of Patent: Jan. 27, 2009

(54) SEALING ARRANGEMENT

(75) Inventors: Heinz Resch, Flawil (CH); Hermann Zwyssig, Niederuzwil (CH)

(73) Assignee: Buhler AG, Uzwil (CH)

( * ) Notice: Subject to any disclaimer, the term of this patent is extended or adjusted under 35 U.S.C. 154(b) by 0 days.

(21) Appl. No.: 10/957,133

(22) Filed: Oct. 4, 2004

(65) Prior Publication Data

US 2005/0091869 A1 May 5, 2005

Related U.S. Application Data

(63) Continuation of application No. PCT/CH03/00123, filed on Feb. 19, 2003.

(30) Foreign Application Priority Data

Apr. 5, 2002 (DE) ..... 102 15 181

(51) Int. Cl.
*F26B 25/00* (2006.01)

(52) U.S. Cl. ..... 34/242

(58) Field of Classification Search ..... 34/201, 34/242; 277/628, 630, 633, 645; 411/542, 411/369, 371.1
See application file for complete search history.

(56) References Cited

U.S. PATENT DOCUMENTS

| | | | | |
|---|---|---|---|---|
| 1,741,342 A | | 12/1929 | Schwartz | |
| 2,554,610 A | * | 5/1951 | Benson | 312/107 |
| 3,175,652 A | | 3/1965 | Brekell et al. | |
| 4,296,540 A | | 10/1981 | Potter | |
| 4,774,773 A | * | 10/1988 | Zwyssig | 34/201 |
| 5,860,693 A | * | 1/1999 | Ehrlich | 296/191 |
| 6,220,651 B1 | | 4/2001 | Ehrlich | |
| 6,450,564 B1 | * | 9/2002 | Sill | 296/186.1 |

FOREIGN PATENT DOCUMENTS

| | | |
|---|---|---|
| DE | 744357 | 1/1944 |
| DE | 1 804 043 | 12/1970 |
| DE | 37 34 818 A1 | 4/1989 |
| DE | 101 58 4446 A1 | 6/2003 |
| EP | 0 011 239 A1 | 5/1980 |
| EP | 0 685 255 A1 | 3/1995 |
| EP | 0 685 255 B1 | 3/1995 |
| GB | 797450 | 7/1958 |
| WO | 85/00090 A1 | 1/1985 |

OTHER PUBLICATIONS

International Preliminary Examination Report issued in corresponding International Application No. PCT/CH2003/000123 on Jun. 25, 2004.

* cited by examiner

*Primary Examiner*—Jiping Lu
(74) *Attorney, Agent, or Firm*—Buchanan Ingersoll & Rooney PC

(57) ABSTRACT

A sealing arrangement is disclosed for sheet-like elements such as flat wall elements (e.g., pasta dryers). A separation joint can be sealed against penetration gases or steam by placing level sealing elements on both sides of the separation joint, the sealing elements being braced against each other by connections, such as screw connection.

1 Claim, 2 Drawing Sheets

SEALING ARRANGEMENT

CROSS REFERENCE TO RELATED APPLICATIONS

This application claims priority under 35 U.S.C. §119 to German Application No. 102 15 181.4 filed in Germany on 5 Apr. 2002, and as a continuation application under 35 U.S.C. §120 to PCT/CH03/00123 filed as an International Application on 19 Feb. 2003 designating the U.S., the entire contents of which are hereby incorporated by reference in their entireties.

BACKGROUND

The invention relates to a sealing arrangement for sheet-like elements or wall elements, in particular for dryers of pasta and the like.

It is known to seal sheet-like elements, for example sheet-like wall elements, against the transmission of gaseous or liquid or else solid substances. This may be performed by sealing compounds or adhesives, which however lead to soiling or permanent connection of the wall elements. Furthermore, it is known for example from EP-A-685255 to seal the outlet flaps of a mixing container in the operating state by means of a pressure roller and a sealing tube. In this case, after swinging in a bar, the pressure roller presses against the location where the flaps overlap. An inflatable sealing tube seals off the side of the flaps respectively lying opposite. Before opening the flaps, the sealing tube must be evacuated.

Further sealing arrangements are known from the documents DE-A-3734818, DE-A-1804043 and U.S. Pat. No. 3,175,652.

In the case of the arrangement of DE-A-3734818, however, no positional compensation is possible parallel to the plane of the separating gap between two neighboring wall elements, because there is a rigid connection between the clamping elements of the sealing elements and the rigid frame of the dryer.

The arrangement of DE-A-1804043 and U.S. Pat. No. 3,175,652 uses sealing elements arranged in the separating gap, the end faces of adjacent wall elements on both sides of the separating gap having to have specially shaped formations complementing the sealing elements arranged in the separating gap.

SUMMARY

A sealing arrangement is disclosed for sheet-like elements or wall elements, for example of pasta dryers, which permit simple connection of such elements while at the same time the location where they are connected is sealed off.

One exemplary feature is that the connection takes place without overlapping of the elements, and consequently assembly and disassembly can also take place with simple means. Moreover, compensation of positional or dimensional deviations is possible, in particular temperature-induced positional or dimensional deviations.

BRIEF DESCRIPTION OF THE DRAWINGS

The invention is described in more detail below by referring to two examples on the basis of a drawing, in which.

DETAILED DESCRIPTION

A multilevel dryer for pasta, as described for example in WO 85/00090 or the applicant's DE 10158446.6, not published before the priority date, the disclosures of which are hereby incorporated by reference in their entireties, has individual dryer sections, which in turn have an outer casing. The casing comprises individual, shaped plates.

Figure 1:
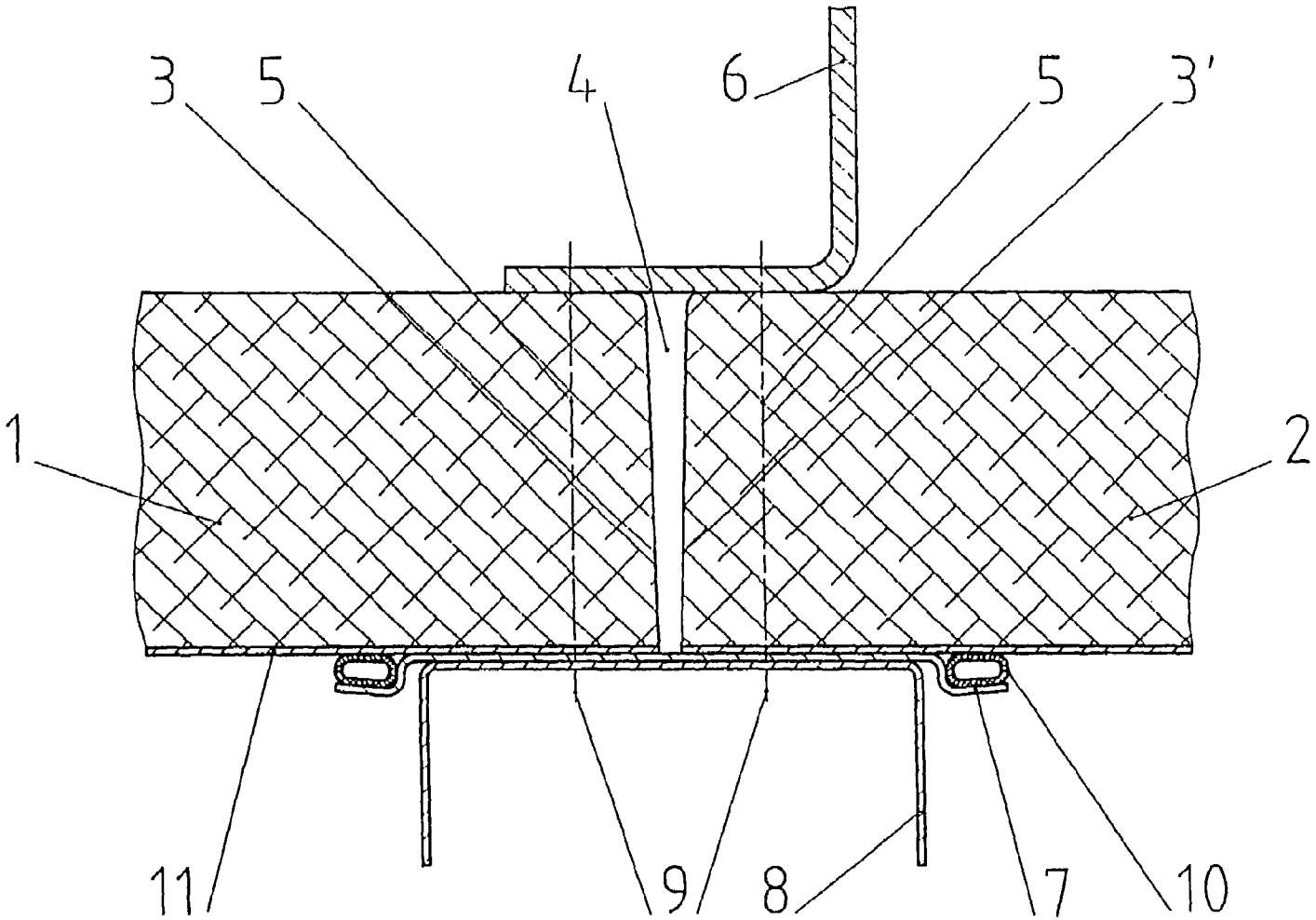
FIG. 1 shows a sealing arrangement in the form of top plate seal.

In the example, a top plate 1 is connected to a further top plate 2 (FIG. 1). The connection takes place by a butt joint at the end faces 3 and 3'. In this case, neither a sealing abutment of the end faces 3 and 3' against each other nor particularly fine working of the end faces 3, 3' is required, so that the separating gap 4 does not have to meet any special requirements.

Parallel to the end face 3, 3', the plates 1 and 2 respectively have through-bores or blind-bores 5. Placed on the inner side of the separating gap 4 is a top crosshead 6 with a planar supporting surface and through-bores analogous to the through-bores 5 of the plates 1, 2 and, on the outer side, a planar sealing strip 7 with analogous through-bores. A further crosshead 8 may be placed on the sealing plate. The positionally fixed fastening of the individual elements takes place as depicted by means of screw connections 9.

The outer regions of the sealing strip 7 are L-shaped parallel to the path of the sealing gap 4, so that a flexible sealing element, here a silicone tube 10, can be additionally placed between the sealing strip 7 and the plates 1, 2.

As a result of the screw connections 9, adequate sealing of the separating gap 4 against vapor or gases is consequently obtained. If need be, however, a further sealing plate 11 may be provided, as depicted, between the separating gap 4 and the sealing strip 7 or the top crosshead 6.

Positional compensation perpendicular to the plane of the separating gap 4 is possible.

Figure 2:
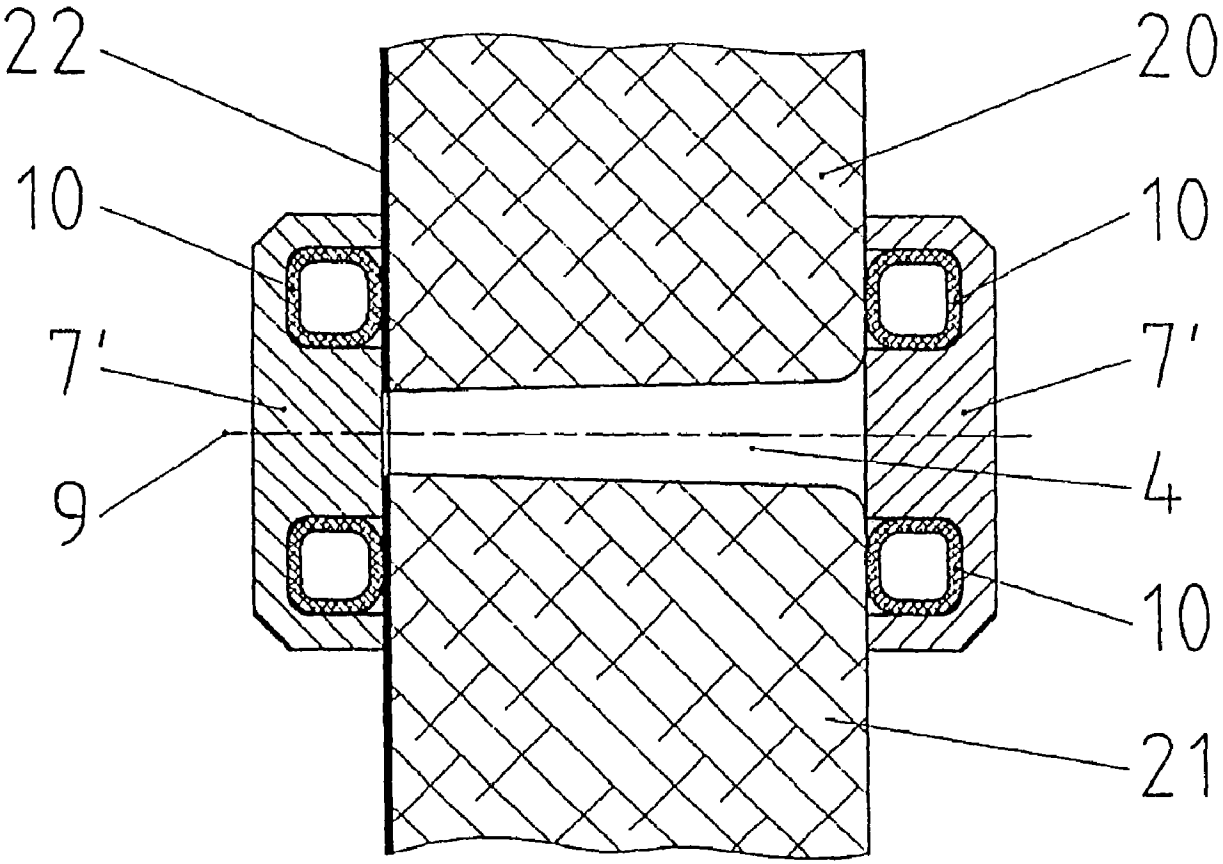
FIG. 2 shows a further embodiment of a sealing joint.

In the case of a sealing joint according to FIG. 2, two casing parts 20, 21 of a multilevel dryer are connected to each other in a sealed manner, forming a separating gap 4, positional compensation parallel to the separating gap 4 being possible.

Both on the inner side and on the outer side of the separating gap 4, a sealing strip 7' is in turn arranged over the entire length thereof, containing a silicone tube 10 to the right and left of the separating gap 4. On the outer side of the sealing joint there is additionally a cover plate 22 (analogous to the top plate 11) between the sealing strip 7' and the casing parts 20, 21. As in the first example, the two sealing strips 7' are clamped against each other by means of a screw connection 9 and reliably seal off the separating gap.

The invention is not restricted to these exemplary embodiments. It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A sealing arrangement for end faces of sheet-like elements of a pasta dryer, the end faces of which are arranged to form a separating gap and wherein through bores extending parallel to the separating gap are arranged in the sheet-like elements on both sides of the separating gap, the arrangement comprising:

two planar sealing means for placement on inner and outer longitudinal sides of the separating gap of the sheet-like elements, wherein one planar sealing means is configured in the form of a crosshead with a planar supporting surface and the other planar sealing means is configured in the form of a planar sealing element and two flexible elements, the flexible elements being provided between a wall of the connected, sheet-like elements and the planar sealing element on both sides of the separation gap, wherein the planar sealing element has L-shaped outer regions receiving the flexible elements, and the planar sealing means have bores placed at locations determined by the bores of the sheet-like elements;

a further crosshead arranged at the planar sealing element; and means for clamping the longitudinal sides in between planar sealing means to form a sealing termination of the separating gap, said means for clamping comprising screw connections extending through the bores of the sheet-like elements on both sides of the separating gap.

* * * * *